US005744085A

United States Patent [19]

Sörberg

[11] Patent Number: 5,744,085

[45] Date of Patent: Apr. 28, 1998

[54] PIPE-END EXPANDING METHOD AND A TOOL THEREFOR

[75] Inventor: Bengt Sörberg, Kungsör, Sweden

[73] Assignee: Wirsbo Bruks AB, Virsbo, Sweden

[21] Appl. No.: 619,549

[22] PCT Filed: Oct. 7, 1994

[86] PCT No.: PCT/SE94/00945

§ 371 Date: Mar. 27, 1996

§ 102(e) Date: Mar. 27, 1996

[87] PCT Pub. No.: WO95/10000

PCT Pub. Date: Apr. 13, 1995

[30] Foreign Application Priority Data

Oct. 7, 1993 [SE] Sweden ..... 9303295

[51] Int. Cl.[6] ..... B29C 57/04

[52] U.S. Cl. ..... 264/296; 264/323; 425/393; 425/DIG. 218

[58] Field of Search ..... 264/296, 320, 264/323; 485/393, 392, DIG. 218; 72/370, 393

[56] References Cited

U.S. PATENT DOCUMENTS

| | | | |
|---|---|---|---|
| 691,446 | 1/1902 | Colby . | |
| 3,989,439 | 11/1976 | Schmitzberger | 264/296 |
| 3,998,578 | 12/1976 | Acda | 425/393 |
| 4,065,953 | 1/1978 | Frentzen et al. | 72/393 |
| 4,157,372 | 6/1979 | Kyomen | 264/296 |
| 4,279,853 | 7/1981 | Ohta et al. | 425/DIG. 218 |
| 4,379,115 | 4/1983 | Seach et al. | 264/296 |
| 4,412,802 | 11/1983 | Ohta et al. | 425/DIG. 218 |
| 4,643,658 | 2/1987 | Gordon | 425/DIG. 218 |
| 5,090,230 | 2/1992 | Koskinen | 72/393 |

*Primary Examiner*—Jan H. Silbaugh
*Assistant Examiner*—Mark Eashoo
*Attorney, Agent, or Firm*—Jacobson, Price, Holman & Stern, PLLC

[57] ABSTRACT

A tool is used for expanding a pipe-end which includes a plurality of jaws that can be moved radially in relation to a centre axis, between a retracted position and an outer expanding position. The jaws are inserted to a given distance in the pipe-end with the jaws in their retracted position. The jaws have outer surfaces which lie adjacent one another in the retracted positions of the jaws and have a circular-arcuate shape in cross section for engagement with the inner surface of the pipe-end. The radial distance of the outer jaw surfaces from the centre axis increases from the insertion end of the jaws to their opposite end. The pipe-end is expanded successively in several stages with relative small jaw movements, wherein the jaws are retracted and inserted further into the pipe-end between each expansion stage. The jaws of the tool can be moved radially through a distance which is smaller than the ultimate radial expansion of the pipe-end.

2 Claims, 2 Drawing Sheets

PIPE-END EXPANDING METHOD AND A TOOL THEREFOR

FIELD OF THE INVENTION

The present invention relates to a method and to a tool for expanding a pipe-end.

BACKGROND OF THE INVENTION

A method of the kind referred to is often used to establish pipe connections, and then primarily for expanding plastic pipes which have a memory capacity, i.e. pipes which automatically strive to return essentially to their original shape and form after having been expanded. One example in this regard is found in pipes that are manufactured from cross-linked polyolefins, and particularly pipes that are manufactured from cross-linked polyethylene, such as so-called PEX-pipes, which possess an active memory capacity at temperatures as low as room temperature. A pipe connection is established by expanding one end of such a pipe and inserting into the widened pipe-end a flanged connector which performs part of a pipe-connecting piece, normally made of metal, and which is retained in said pipe-end until the pipe is shrunk to an extent at which it is able to firmly grip the connecting piece. Optionally, a clamping sleeve made of a resilient material, for instance metal or plastic, which may be the same plastic material as that from which the pipe is made, is expanded and shrunk over the pipe-end in order to further enhance the holding and sealing pressure at the pipe connecting region. The clamping sleeve can be expanded at the same time as the pipe-end is expanded, with the clamping sleeve in position around said pipe-end.

One drawback with those expanding methods and expanding tools of the kind defined in the introduction and known hitherto is that the opposing edges of the outer jaw surfaces, which are generally circular-arcuate in cross-section, tend to produce on the inner surface of the pipe-end as said pipe-end expands pronounced, continuous grooves or score lines which extend in the direction of the longitudinal axis of the pipe. When fluid under pressure flows through a pipe connection that has been established by the expansion method, the fluid tends to follow the aforesaid score lines and therewith seep through the pipe connection. This deficiency in the tightness of the joint is particularly accentuated during the hours immediately after the pipe connection has been made.

SUMMARY OF THE INVENTION

The object of the present invention is to provide a novel and advantageous method and tool which will eliminate the aforesaid drawback at least to a substantial extent.

To this end, there is proposed a method and a tool of the kind defined in the introduction. The pipe-end is thus expanded in stages, i.e. the mutually retracted jaws are inserted to a given distance in a pipe-end and then brought to an expanded state while expanding the pipe-end to a relatively small extent, whereafter the jaws are again brought together or retracted and inserted further into the pipe-end. The jaws are then again brought to an expanding state while further expanding the pipe-end. The method is repeated until the pipe-end has been expanded to the extent desired, for instance until the outer jaw surfaces have been inserted to their full length into the pipe-end and brought to an expanded state, whereupon the jaws are withdrawn from said pipe-end after having been returned to their retracted state or position. Because the pipe-end is expanded in stages with only small expansion movements of the jaws, the longitudinally extending edges of the delimiting outer jaw surfaces are always moved only a small distance apart and therewith produce no or only insignificant score lines in the inner surface of the pipe-end. This avoids the aforedescribed leakage problem.

The invention will now be described in more detail with reference to the accompanying drawings, in which

DETAILED DESCRIPTION OF THE PREFERRED EMBODIMENTS

Figure 1:
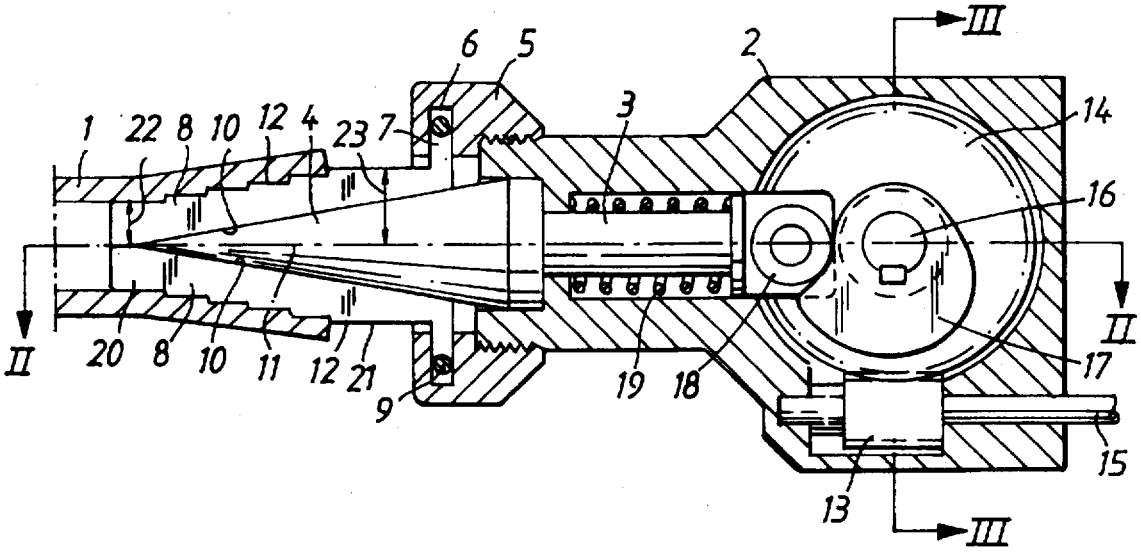
FIG. 1 is a vertical section view of the most important part of an expansion tool for carrying out the inventive method.
Figure 2:
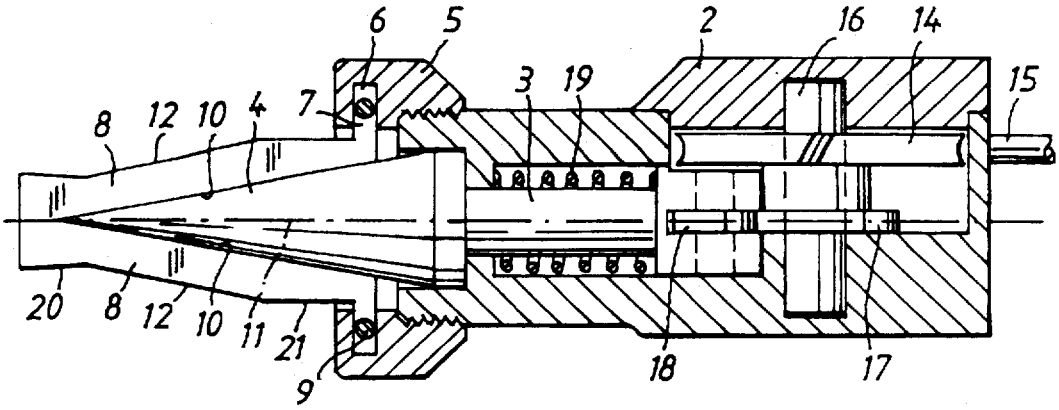
FIG. 2 is a sectional view taken on the line II—II in FIG. 1 although with a modified design.
Figure 3:
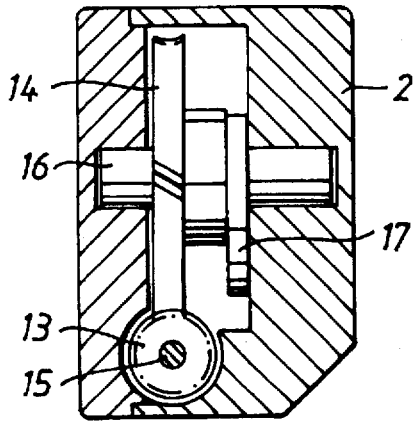
FIG. 3 is a sectional view taken on the line III—III in FIG. 1.

FIGS. 1–3 illustrate the significant part of a tool which can be used conveniently to expand a pipe-end 1 in conjunction with establishing a pipe connection. The tool includes a casing 2 in which a piston 3 or the like having a pointed front end of polygonal cross-section can be moved reciprocatingly by means of a drive arrangement described below. The front of the casing 2 has a screw-on cover 5 which includes a through-penetrating central opening and a circular groove 6 in which radial parts 7 of jaws 8 are received in a manner which will permit the jaws 8 to move radially but not axially relative to the ring groove 6. The parts 7 are provided with peripheral grooves which receive an annular spring 9 which surrounds the jaws and which endeavours to hold the jaws in their retracted state or in a position in which they lie against the piston-end 4. The tool is expanded by moving the piston 3 forwards from its withdrawn position shown in FIGS. 1 and 2, wherewith the pointed end 4 of the piston engages bevelled surfaces 10 on the jaws 8 and forces the jaws apart. It is assumed in the illustrated case that the jaws 8 are six in number and that said jaws move radially outwards in relation to a centre axis 11. The jaws have outer jaw surfaces 12 which when seen in cross-section at right angles to the axis 11 are at least generally arcuate in shape and lie adjacent one another when the jaws 8 are in their mutually retracted state or position.

The aforesaid drive arrangement includes a gear mechanism comprised of a gear drive 13 and a gear wheel 14. The drive 13 is powered by an electric motor (not shown) connected to the drive input shaft 15. The gear wheel 14 is fixedly mounted on a shaft 16 which is journalled in the casing 2 and which carries a camming disc 17. The camming disc 17 coacts with a cam follower in the form of a roller 18 mounted on the rear end of the piston 3. A pressure spring 19 acting between the casing 2 and the piston 3 endeavors to hold the roller 18 in contact with the camming disc.

The radial distance of respective outer jaw surfaces 12 from the centre axis 11 increases from their forward ends or insertion ends 20 to their opposite or rear end 21. These distances are shown at 22 and 23 respectively in FIG. 1. This increase in distance can be effected stepwise, for instance in accordance with FIG. 1, or continuously, for instance in accordance with FIG. 2, in at least an intermediate region between the insertion end 20 and the rear end 21 of the jaw surfaces. When the radial distance is increased stepwise, the radial extent of each incremental increase will preferably be at most equal to the distance through which jaws travel radially as they move between the retracted position and the expanded position.

A particular advantage is gained when the radial distance of the outer jaw surfaces 12 from the centre axis 11 is constant in a region rearwardly of said intermediate region, i.e. in the region of the end 21, as shown in FIGS. 1 and 2. The radial distance of the outer jaw surfaces 12 from the centre axis 11 may also be constant in the region forwardly of said intermediate region, i.e. in the region of the end 20, or may optionally decrease in a direction towards the rear end 21, as shown in FIG. 2. This rearward sloping of the outer jaw surfaces prevents the pipe-end 1 from sliding out of the jaws unintentionally as the pipe-end expands. The pipe-end can also be prevented from sliding unintentionally from the jaws by providing the jaw surfaces 12 with peripherally extending grooves or serrations.

When expanding one end 1 of a pipe which is made of material having a memory capacity, the jaws 8 are contracted so that the outer diameter of the insertion end 20 of the tool will be essentially equal to the inner diameter of the pipe-end to be expanded. The insertion end 20 of the tool is inserted into said pipe-end to an extent which is much shorter than the full length of the jaws. The jaws 8 are moved apart and then returned to their retracted position and the tool is then moved further into the now slightly expanded pipe-end 1. The procedure is repeated until the pipe-end 1 is in abutment with the cover 5. A pipe-connecting piece can be inserted into the widened pipe-end after removing the jaws 8 therefrom, and the pipe-end crimped around said connecting piece. The camming disc or curve 17 is intended to be rotated in an anti-clockwise direction and is constructed advantageously in the shown manner as a delaying device which during each revolution or movement cycle will hold the jaws 8 for a while in their expanded position. It should be pointed out in this context, however, that the inventive tool need not be driven electrically, but may be driven manually, pneumatically or hydraulically.

Figure 4:
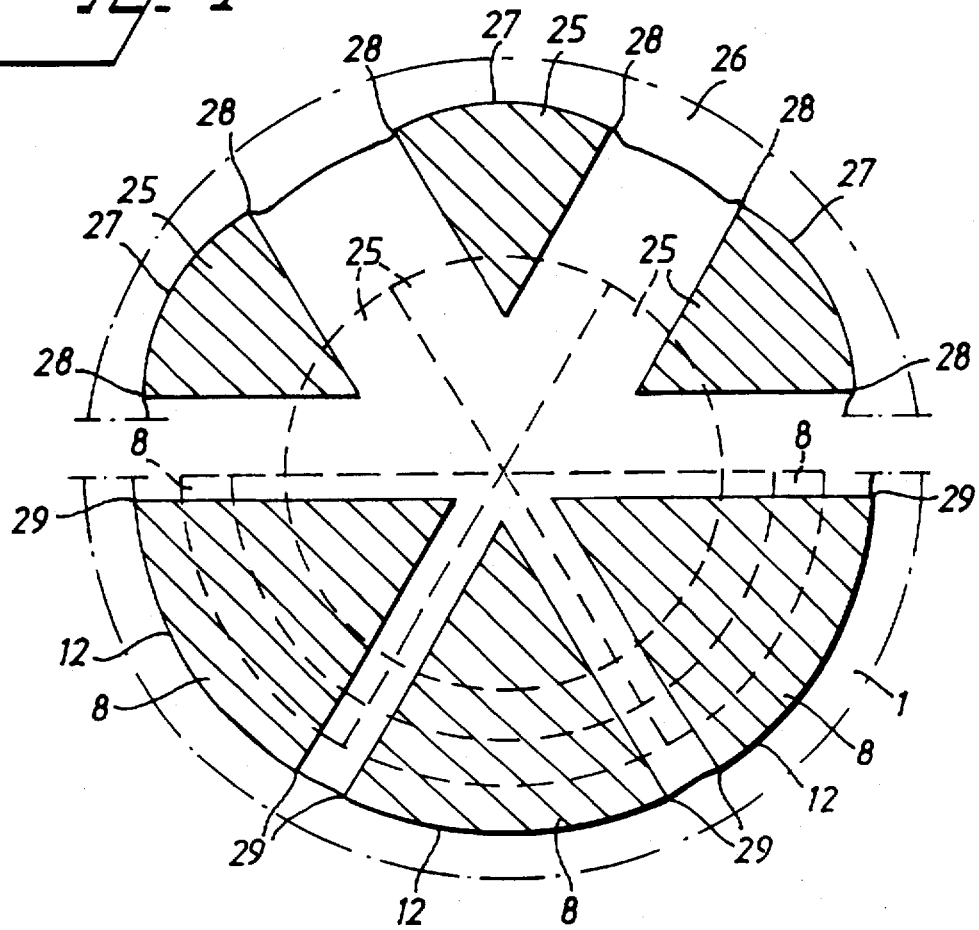
FIG. 4 is a cross-sectional view in which the upper half of the Figure shows the jaws of a conventional tool in a retracted and expanded state respectively, and the bottom half Figure shows the jaws of a tool for carrying out the inventive method in a respective retracted and expanded state.

The advantage gained by the inventive method is illustrated in FIG. 4. The upper part of FIG. 4 shows in broken lines the jaws 25 of a conventional tool in their retracted position in which they can be inserted into a non-expanded pipe-end. The Figure shows in full lines the jaws 25 in an expanded state and acting on a pipe-end 26, of which only the inner material layer is shown in the Figure. It will be seen that the edges 28 of the outer jaw surfaces 27 in the expanded state are spaced far apart and score the inner surface of the pipe, these score lines tending to result in a leaky joint. The bottom half of FIG. 4 also shows the jaws 8 in their respective retracted positions in broken lines and in their respective expanded positions in full lines. The jaws 8 have generally the same configuration as the jaws shown in FIG. 1 and their edges 29 are spaced at a relatively small distance apart when the jaws are expanded and will therefore give rise to minimal score lines in the inner surface of the pipe-end 1.

It will be understood that the invention is not restricted to the aforedescribed and illustrated exemplifying embodiments thereof and that the invention can be realized in any chosen manner within the scope of the inventive concept as defined in the following claims.

I claim:

1. A method of expanding a pipe-end made of a plastic material that has a memory capacity by a tool which includes a plurality of jaws that are movable radially in relation to a centre axis between a retracted position and an outer expanded position, said jaws having outer jaw surfaces for engagement with an inner surface of the pipe-end and which lie adjacent one another in the retracted position of the jaws and have an at least generally circular-arcuate shape in cross-section, said tool including means for moving the jaws between the positions, a radial distance of respective outer jaw surfaces from a centre axis increasing from an insertion end to a rear end, and for expanding the pipe-end, comprising:

inserting the jaws a given distance into the pipe-end with the jaws retracted, then expanding the pine-end successively in a plurality of expansion stages by moving the jaws in each expansion stage through a small radial distance, wherein the jaws are moved from the retracted position radially outwards to the outer expanded position of said jaws, in relation to a final radial expansion of the pipe-end, and moving the jaws to the retracted position and inserting the jaws while retracted further into the pipe-end between each expansion stage.

2. A method according to claim 1, wherein the tool has jaws which are radially movable through a distance which is smaller than the final radial expansion of the pipe-end.

* * * * *